US010490343B2

(12) United States Patent
Takayama et al.

(10) Patent No.: US 10,490,343 B2
(45) Date of Patent: Nov. 26, 2019

(54) COMMON MODE CHOKE COIL

(71) Applicant: MURATA MANUFACTURING CO., LTD., Kyoto-fu (JP)

(72) Inventors: Kota Takayama, Nagaokakyo (JP); Yoshihiro Imanishi, Nagaokakyo (JP); Yu Ishiwata, Nagaokakyo (JP); Kiyomi Ikemoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 150 days.

(21) Appl. No.: 15/599,611

(22) Filed: May 19, 2017

(65) Prior Publication Data

US 2018/0005752 A1 Jan. 4, 2018

(30) Foreign Application Priority Data

Jul. 1, 2016 (JP) ..... 2016-131193

(51) Int. Cl.
*H01F 21/02* (2006.01)
*H01F 5/00* (2006.01)
(Continued)

(52) U.S. Cl.
CPC ..... *H01F 27/42* (2013.01); *H01F 17/0013* (2013.01); *H01F 27/06* (2013.01);
(Continued)

(58) Field of Classification Search
USPC ..... 336/15, 200, 232, 83; 257/531
See application file for complete search history.

(56) References Cited

U.S. PATENT DOCUMENTS 6,489,875 B1 * 12/2002 Uchikoba ..... H01F 17/0013 336/192
6,977,573 B1 * 12/2005 Maeda ..... H01F 5/003 336/200

(Continued)

FOREIGN PATENT DOCUMENTS

CN 106537532 A 3/2017
JP S636132 B2 2/1988

(Continued)

OTHER PUBLICATIONS

An Office Action; "Notification of Reasons for Refusal," Mailed by the Japanese Patent Office dated Jan. 22, 2019, which corresponds to Japanese Patent Application No. 2016-131193 and is related to U.S. Appl. No. 15/599,611; with English language translation.

(Continued)

*Primary Examiner* — Elvin G Enad
*Assistant Examiner* — Kazi Hossain
(74) *Attorney, Agent, or Firm* — Studebaker & Brackett PC

(57) ABSTRACT

Three or more of n inductors are arranged inside an insulating member. Inside the insulating member, each of the inductors includes coil conductors that are contained in respective coil conductor layers that are stacked in a first direction and via conductors, each of which connects the coil conductors that are contained in the coil conductor layers adjoining in the first direction. Each of the coil conductor layers contains the n coil conductors of the inductors, and a pattern formed of the coil conductors contained in each of the coil conductor layers has n-fold rotational symmetry.

4 Claims, 8 Drawing Sheets

(51) Int. Cl.

| | |
|---|---|
| ***H01F 27/28*** | (2006.01) |
| ***H01F 27/42*** | (2006.01) |
| ***H01F 27/06*** | (2006.01) |
| ***H01F 27/32*** | (2006.01) |
| ***H01F 17/00*** | (2006.01) |

(52) U.S. Cl.

CPC ..... *H01F 27/28* (2013.01); *H01F 27/324* (2013.01); *H01F 2017/004* (2013.01); *H01F 2017/0073* (2013.01); *H01F 2017/0093* (2013.01); *H01F 2027/2809* (2013.01)

(56) References Cited

U.S. PATENT DOCUMENTS

| | | | | |
|---|---|---|---|---|
| 2007/0001794 | A1 | | 1/2007 | Alford et al. |
| 2008/0258840 | A1 | * | 10/2008 | Sato ..... H01P 1/20 |
| 2011/0032065 | A1 | | 2/2011 | Raczkowski |
| 2014/0125445 | A1 | | 5/2014 | Sim et al. |
| 2017/0133152 | A1 | | 5/2017 | Kouchi et al. |

FOREIGN PATENT DOCUMENTS

| | | | | |
|---|---|---|---|---|
| JP | 2002-246244 | A | | 8/2002 |
| JP | 2004-063952 | | * | 2/2004 |
| JP | 2004063952 | A | | 2/2004 |
| JP | 2004165448 | A | | 6/2004 |
| JP | 2005050956 | A | | 2/2005 |
| JP | 2007-506263 | A | | 3/2007 |
| JP | 3952971 | B2 | | 8/2007 |
| JP | 2010-045127 | A | | 2/2010 |
| JP | 2011-040509 | A | | 2/2011 |
| JP | 2014-096588 | A | | 5/2014 |

OTHER PUBLICATIONS

An Office Action; "Notification of Reasons for Refusal," Mailed by the Japanese Patent Office dated Jul. 23, 2019, which corresponds to Japanese Patent Application No. 2016-131193 and is related to U.S. Appl. No. 15/599,611; with English language translation.

* cited by examiner

COMMON MODE CHOKE COIL

CROSS REFERENCE TO RELATED APPLICATIONS

This application claims benefit of priority to Japanese Patent Application 2016-131193 filed Jul. 1, 2016, the entire content of which is incorporated herein by reference.

TECHNICAL FIELD

The present disclosure relates to a common mode choke coil.

BACKGROUND

Japanese Unexamined Patent Application Publication No. 2002-246244 and Japanese Patent No. 3952971 each disclose a common mode choke coil including three winding coils.

In the common mode choke coil disclosed in Japanese Unexamined Patent Application Publication No. 2002-246244, three wires are wound in a regular manner on a signal input electrode side, and the three wires are wound in an isolated manner on a signal output electrode side.

In the common mode choke coil disclosed in Japanese Patent No. 3952971, a first wire and a second wire are wound around a first layer of a winding core portion, and a third wire is wound around a recessed portion between the first wire and the second wire that are wound around the first layer. This structure enables distances between the centers of any two wires of the three wires to be equal.

SUMMARY

In the common mode choke coil disclosed in Japanese Unexamined Patent Application Publication No. 2002-246244, in which the three wires are wound in a regular manner around a core, the distance between a turn of the wire located at the outermost end and a turn of each of the other two wires varies. Accordingly, the degree of coupling between the wires varies. Consequently, the normal mode impedance of each of three lines, into which the common mode choke coil is inserted, varies between the three lines depending on the combination of two lines.

The common mode choke coil disclosed in Japanese Patent No. 3952971 is adapted to achieve uniform distances between the three wires. However, the diameter of two inductors each formed of the first and second wires wound around the first layer differs from the diameter of an inductor formed of the third wire wound around the recessed portion between the first and second wires wound around the first layer. For this reason, the self-inductance of the two inductors formed of the first and second wires wound around the first layer differs from the self-inductance of the inductor formed of the third wire. Consequently, the normal mode impedance of each of three lines, into which the corresponding three inductors are inserted, varies between the three lines depending on the combination of two lines.

It is an object of the present disclosure to provide a common mode choke coil that enables a variation in the normal mode impedance between the lines to be decreased.

According to preferred embodiments of the present disclosure, a common mode choke coil includes an insulating member, and three or more of n inductors arranged inside the insulating member. Inside the insulating member, each of the inductors includes coil conductors that are contained in respective coil conductor layers that are stacked in a first direction and via conductors, each of which connects the coil conductors that are contained in the coil conductor layers adjoining in the first direction. Each of the coil conductor layers contains the n coil conductors of the inductors, and a pattern formed of the coil conductors contained in each of the coil conductor layers has n-fold rotational symmetry.

A variation in the degree of coupling of two inductors selected from the n inductors is reduced. Accordingly, when the common mode choke coil is inserted into a transmission line formed of n lines, a variation in the normal mode impedance between the lines is decreased. In addition, the size of components of the common mode choke coil can be smaller than components of a common mode choke coil having a winding structure.

In the common mode choke coil according to preferred embodiments of the present disclosure, the n coil conductors contained in each of the coil conductor layers form respective arc patterns having the same center and the same radius.

In the case where the coil conductors form the arc patterns, the degree of symmetry of the coil conductors can be increased. For example, the shape of the coil conductors of each coil conductor layer can be the same as in the other coil conductor layers.

In the common mode choke coil according to preferred embodiments of the present disclosure, the number of the inductors arranged inside the insulating member is three.

For example, in the case where the common mode choke coil is inserted into a transmission line formed of three lines, a variation in the normal mode impedance between the lines is decreased.

According to preferred embodiments of the present disclosure, the common mode choke coil includes outer electrodes arranged on a surface of the insulating member, and lead conductors, each of which connects each of the outer electrodes to the corresponding one of the n inductors.

In the case where the common mode choke coil is mounted on a mounting substrate, the mounting area of the common mode choke coil can be decreased.

A variation in the degree of coupling of two inductors selected from the n inductors is reduced. Accordingly, when the common mode choke coil is inserted into a transmission line formed of n lines, a variation in the normal mode impedance between the lines is decreased. In addition, the size of components of the common mode choke coil can be smaller than components of a common mode choke coil having a winding structure.

Other features, elements, characteristics and advantages of the present disclosure will become more apparent from the following detailed description of preferred embodiments of the present disclosure with reference to the attached drawings.

DETAILED DESCRIPTION

First Embodiment

A common mode choke coil according to a first embodiment will be described with reference to FIG. 1 to FIG. 3C.

Figure 1:
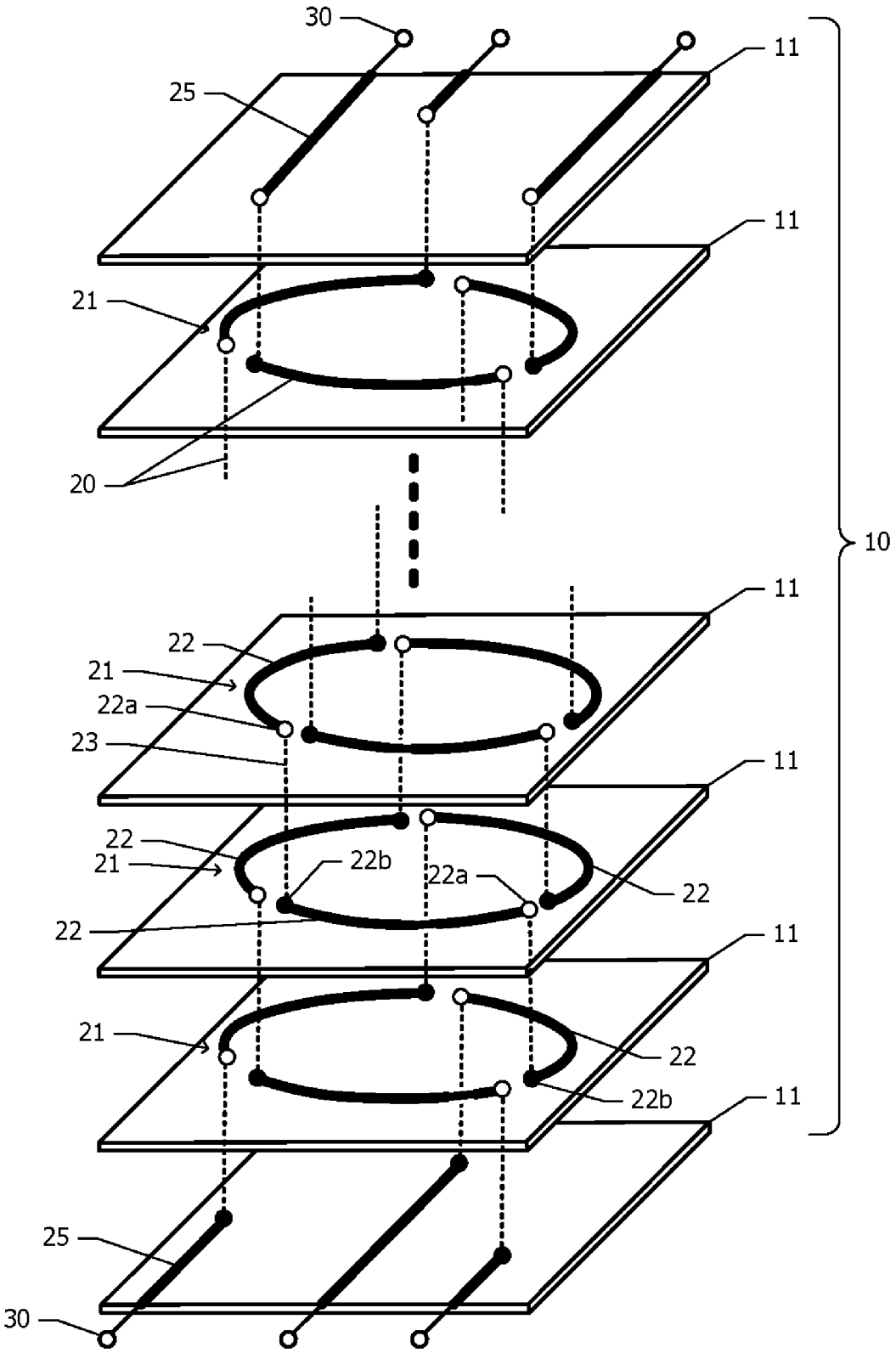
FIG. 1 is a schematic exploded perspective view of a common mode choke coil according to a first embodiment.

FIG. 1 is a schematic exploded perspective view of the common mode choke coil according to the first embodiment. The common mode choke coil according to the first embodiment includes an insulating member 10 formed of insulating layers 11, inductors 20, for example, three inductors 20 arranged inside the insulating member 10, and outer electrodes 30 connected to both ends of each of the inductors 20. The insulating layers 11 are formed, for example, by firing a green sheet or a glass paste containing ferrite powder.

Coil conductor layers 21 are arranged so as to be stacked in a first direction (stacking direction) inside the insulating member 10. For example, the coil conductor layers 21 are arranged at respective interfaces between the insulating layers 11 adjoining in the stacking direction. The number of coil conductors 22 contained in each of the coil conductor layers 21 corresponds to the number of the inductors 20, for example, there are three coil conductors 22 in each of the coil conductor layers 21 according to the embodiment. That is, each of the coil conductor layers 21 contains the corresponding one of the coil conductors 22 of each inductor 20. The coil conductors 22 are formed, for example, by etching copper foil by using a photolithography technique or by applying a copper paste by screen printing and firing the copper paste.

Each of the three inductors 20 includes the coil conductors 22 contained in the coil conductor layers 21 and via conductors 23, each of which connects the coil conductors 22 that are arranged in the coil conductor layers 21 adjoining in the stacking direction. Some of the coil conductors 22 are connected at an end portion thereof, that is, a start point 22*a*, to another coil conductor 22 in the coil conductor layer 21 located just below, with the corresponding via conductors 23 interposed therebetween and are connected at the other end portion, that is, an end point 22*b*, to another coil conductor 22 in the coil conductor layer 21 located just above, with the corresponding via conductors 23 interposed therebetween. In FIG. 1, each start point 22*a* is denoted by a hollow circle, and each end point 22*b* is denoted by a filled circle.

Lead conductors 25 are arranged outside the coil conductor layers 21 on both end sides in the stacking direction. Both ends of each inductor 20 are connected to the corresponding outer electrodes 30 with the corresponding lead conductors 25 interposed therebetween.

The three coil conductors 22 contained in each coil conductor layer 21 have three-fold rotational symmetry. That is, when a pattern formed of the three coil conductors 22 rotates about 120 degrees about a central point, the pattern overlaps the original pattern. More generally, in the case where the number of the inductors 20 is n (n is an integer of 3 or more), a pattern formed of the n coil conductors 22 contained in each coil conductor layer 21 has n-fold rotational symmetry. That is, when a pattern formed of the n coil conductors 22 rotates about 360/n degrees about a central point, the pattern overlaps the original pattern. The n inductors 20 as a whole have n-fold rotational symmetry with a rotation center being a central axis parallel to the stacking direction.

For example, the three coil conductors 22 contained in each coil conductor layer 21 form respective arc patterns having the same center and the same radius. The central angle of the arc pattern formed of each coil conductor 22 is slightly less than 120 degrees.

Figure 2A:
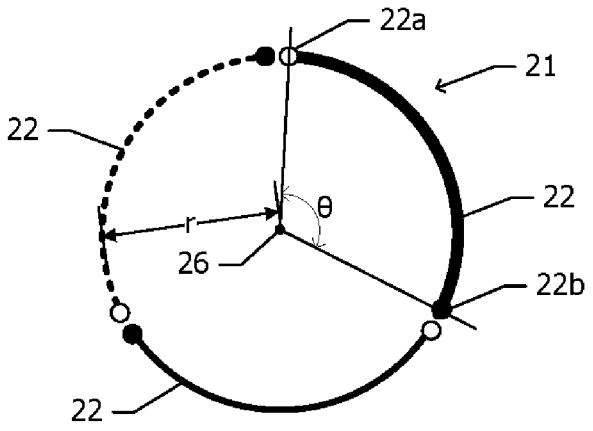
FIG. 2A is a plan view of a first coil conductor layer of the common mode choke coil according to the first embodiment.
Figure 2B:
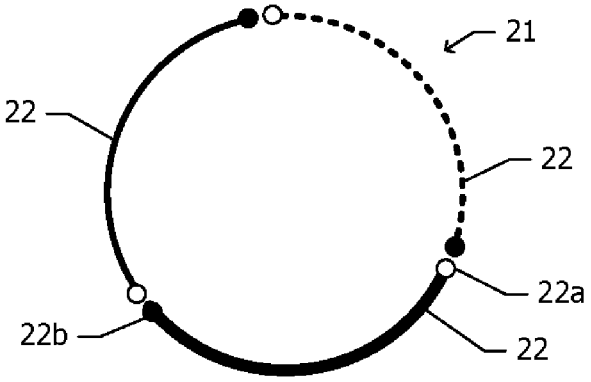
FIG. 2B is a plan view of a second coil conductor layer of the common mode choke coil according to the first embodiment.
Figure 2C:
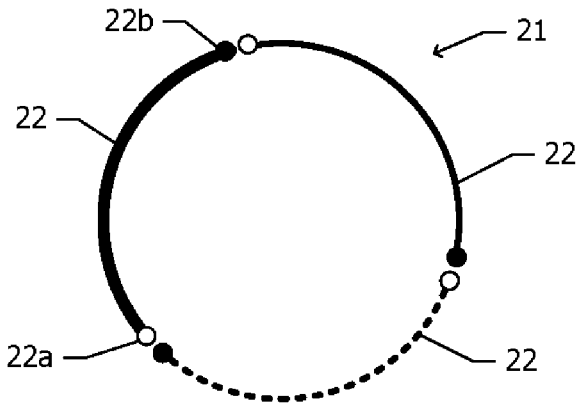
FIG. 2C is a plan view of a third coil conductor layer of the common mode choke coil according to the first embodiment.

FIG. 2A is a plan view of the first coil conductor layer 21. FIG. 2B is a plan view of the second coil conductor layer 21. FIG. 2C is a plan view of the third coil conductor layer 21. The coil conductors 22 of the first inductor 20 are denoted by a thick solid line. The coil conductors 22 of the second inductor 20 are denoted by a thin solid line. The coil conductors 22 of the third inductor 20 are denoted by a dashed line.

As illustrated in FIG. 2A to FIG. 2C, the arc patterns formed of the three coil conductors 22 have the same center 26 and the same radius r. One end portion of each coil conductor is referred to as the start point 22*a*, and the other end portion is referred to as the end point 22*b*. The start point 22*a* and the end point 22*b* are defined such that the rotation direction from the start point 22*a* to the end point 22*b* corresponds to a clockwise direction.

The start point 22*a* (see, for example, FIG. 2B) of each of the coil conductors 22 that are contained in neither the bottom layer nor the top layer is connected to the end point 22*b* (see, for example, FIG. 2A) of another coil conductor 22 located just below, with the corresponding via conductor 23 (FIG. 1) interposed therebetween. The end point 22*b* (see, for example, FIG. 2B) of each of the coil conductors 22 that are contained in neither the bottom layer nor the top layer is connected to the start point 22*a* (see, for example, FIG. 2C) of another coil conductor 22 located just above, with the corresponding via conductor 23 (FIG. 1) interposed therebetween. In order to achieve such a connection structure, the start point 22*a* of one of the coil conductors 22 in an upper layer is located just above the end point 22*b* of another of the coil conductors 22, and the end point 22*b* of one of the coil conductors 22 in a lower layer is located just below the start point 22*a* of another of the coil conductors 22.

The start point 22*a* (FIG. 2A) of each coil conductor 22 in the bottom layer (first layer) is connected to the corresponding lead conductor 25 (FIG. 1) located below, with the corresponding via conductor 23 (FIG. 1) interposed therebetween. The end point 22*b* of each coil conductor 22 in the top layer is connected to the corresponding lead conductor 25 (FIG. 1), with the corresponding via conductor 23 (FIG. 1) interposed therebetween.

The central angle θ of the arc pattern formed of each coil conductor 22 is slightly less than 120 degrees. In order to increase the number of turns of each inductor 20 with a smaller number of layers, it is preferable that the central angle θ be as large as possible, provided that the coil conductors 22 in the same layer do not short-circuit.

The coil conductors 22 contained in the different coil conductor layers 21 are arranged apart from each other in the circumferential direction. Since each coil conductor 22 is formed in an arc shape, the same shape can be maintained even when the coil conductors 22 contained in the different coil conductor layers 21 are arranged apart from each other in the circumferential direction.

Figure 3A:
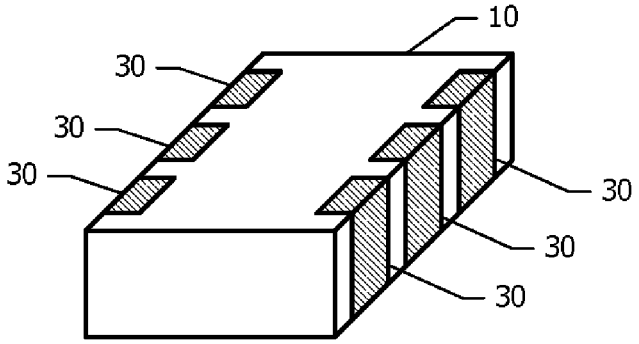
FIG. 3A is a perspective view of the common mode choke coil according to the first embodiment.

FIG. 3A is a perspective view of the common mode choke coil according to the first embodiment. The insulating member 10 included in the common mode choke coil is formed in a shape of a substantially rectangular cuboid. The height direction of the rectangular cuboid corresponds to the stacking direction of the insulating layers 11. Three outer electrodes 30 are formed on each of a pair of side surfaces that are opposite to each other. The outer electrodes 30 are denoted by hatching. The outer electrodes 30 extend from the lower end of the side surfaces to the upper end thereof and extend to part of the bottom surface and part of the upper surface. As illustrated in FIG. 1, the outer electrodes 30 are connected to the inductors 20.

Figure 3B:
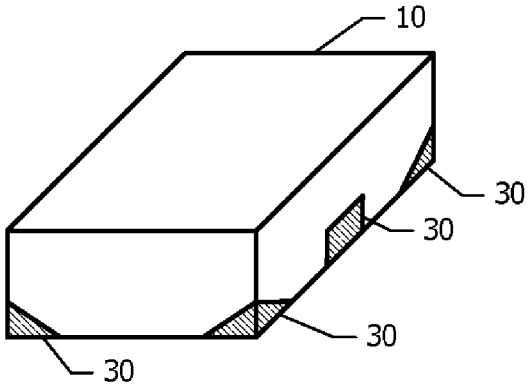
FIG. 3B is a perspective view of a common mode choke coil according to a modification to the first embodiment.
Figure 3C:
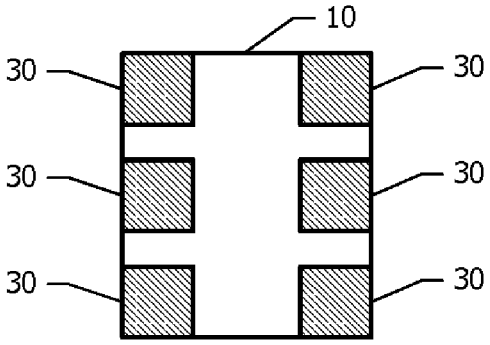
FIG. 3C is a bottom view of the common mode choke coil according to the modification to the first embodiment.

FIG. 3B is a perspective view of a common mode choke coil according to a modification to the first embodiment. FIG. 3C is a bottom view of the common mode choke coil according to the modification to the first embodiment. Also, according to the modification, the insulating member 10 included in the common mode choke coil is formed in a shape of a substantially rectangular cuboid.

As illustrated in FIG. 3C, six outer electrodes 30 are partially formed on the bottom surface. Four outer electrodes are arranged on areas containing corners of the bottom surface, and the other two outer electrodes 30 are arranged on areas containing middle points on a pair of sides that are opposite to each other. As illustrated in FIG. 3B, the outer electrodes 30 extend to part of the side surfaces.

The effects of the first embodiment will now be described. According to the first embodiment, the degree of coupling of any two inductors 20 selected from the three inductors 20 (FIG. 1) is substantially equal. Accordingly, when the common mode choke coil according to the first embodiment is inserted into a transmission line formed of three lines, the normal mode impedance of each of the lines is equal to the normal mode impedance of the other lines. In addition, the size of components of the common mode choke coil can be smaller than components of a common mode choke coil having a winding structure. Accordingly, the mounting area of the common mode choke coil can be decreased.

According to the first embodiment, the coil conductors 22 contained in each coil conductor layer 21 have a shape that substantially follows a circle. However, the coil conductors 22 may have a shape that substantially follows another planar shape having rotational symmetry other than a circle. When the number of the inductors 20 is n, the coil conductors 22 preferably have a shape that substantially follows a planar shape having n-fold rotational symmetry. For example, when the number of the inductors 20 is three, the coil conductors 22 may have a shape that substantially follows, for example, an equilateral triangle or a regular hexagon. When the number of the inductors 20 is four, the coil conductors 22 may have a shape that substantially follows, for example, a square or a regular octagon.

The number of the coil conductor layers 21 stacked may be determined in accordance with the required inductance. In the case where a large inductance is needed, the number of the coil conductor layers 21 may be increased.

Second Embodiment

A common mode choke coil according to a second embodiment will be described with reference to FIG. 4A to FIG. 4C. The following description includes differences from the first embodiment, but a common structure is omitted. According to the first embodiment, the coil conductors 22 contained in the coil conductor layers 21 have a planar shape that substantially follows a circle. According to the second embodiment, the coil conductors 22 have a planar shape that substantially follows the sides of an equilateral triangle.

Figure 4A:
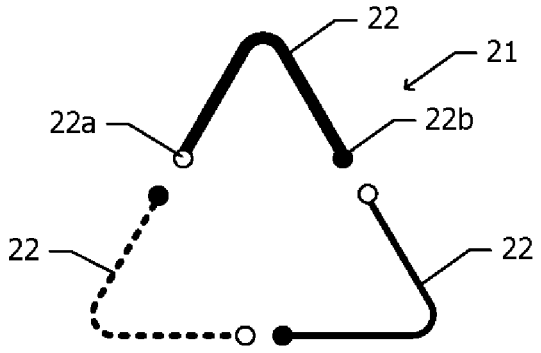
FIG. 4A is a plan view of a first coil conductor layer of a common mode choke coil according to a second embodiment.
Figure 4B:
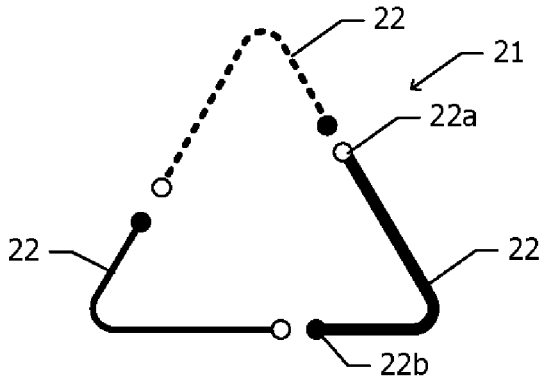
FIG. 4B is a plan view of a second coil conductor layer of the common mode choke coil according to the second embodiment.
Figure 4C:
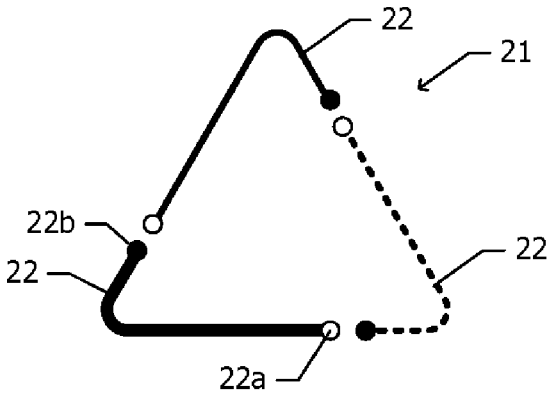
FIG. 4C is a plan view of a third coil conductor layer of the common mode choke coil according to the second embodiment.

FIG. 4A is a plan view of the first coil conductor layer 21 of the common mode choke coil according to the second embodiment. FIG. 4B is a plan view of the second coil conductor layer 21 of the common mode choke coil according to the second embodiment. FIG. 4C is a plan view of the third coil conductor layer 21 of the common mode choke coil according to the second embodiment. The coil conductors 22 in every layer have a shape that substantially follows the sides of an equilateral triangle. The coil conductors 22 are rounded at positions corresponding to the vertexes of the equilateral triangle. A pattern formed of three coil conductors 22 contained in each coil conductor layer 21 has three-fold rotational symmetry.

The start point 22*a* of one of the coil conductors 22 in an upper layer is located just above the end point 22*b* of another of the coil conductors 22 contained in each coil conductor layer 21, and the end point 22*b* of one of the coil conductors 22 in a lower layer is located just below the start point 22*a* of another of the coil conductors 22. The coil conductors 22 contained in the different coil conductor layers are arranged apart from each other in the circumferential direction. For this reason, the coil conductors 22 contained in the different coil conductor layers 21 do not have the same planar shape.

Also, according to the second embodiment, the degree of coupling of any two inductors 20 selected from the three inductors 20 (FIG. 1) is substantially equal. Accordingly, the same effects as in the first embodiment can be achieved.

Third Embodiment

A common mode choke coil according to a third embodiment will be described with reference to FIG. 5A to FIG. 5C. The following description includes differences from the first embodiment, but a common structure is omitted. According to the first embodiment, the common mode choke coil includes three inductors 20. According to the third embodiment, the common mode choke coil includes four inductors 20.

Figure 5A:
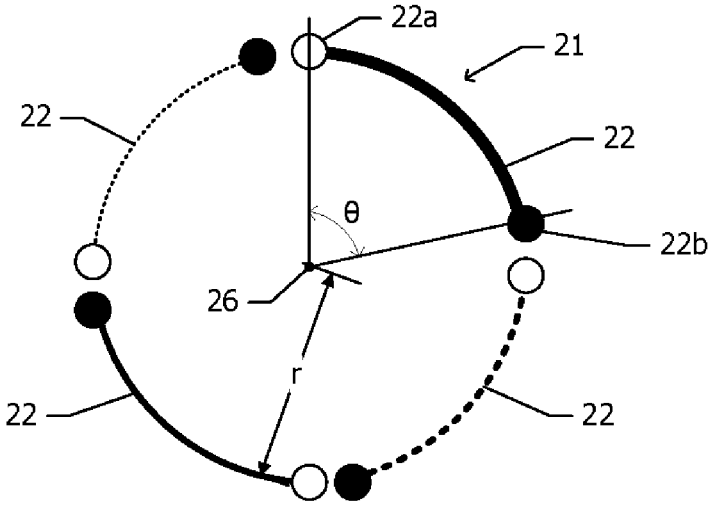
FIG. 5A is a plan view of a first coil conductor layer of a common mode choke coil according to a third embodiment.
Figure 5B:
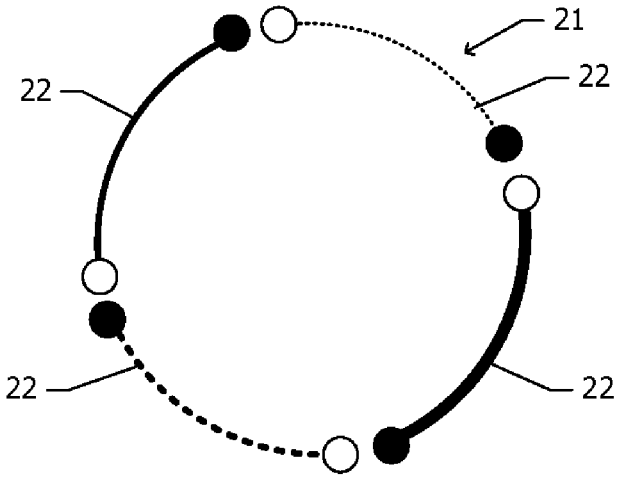
FIG. 5B is a plan view of a second coil conductor layer of the common mode choke coil according to the third embodiment.
Figure 5C:
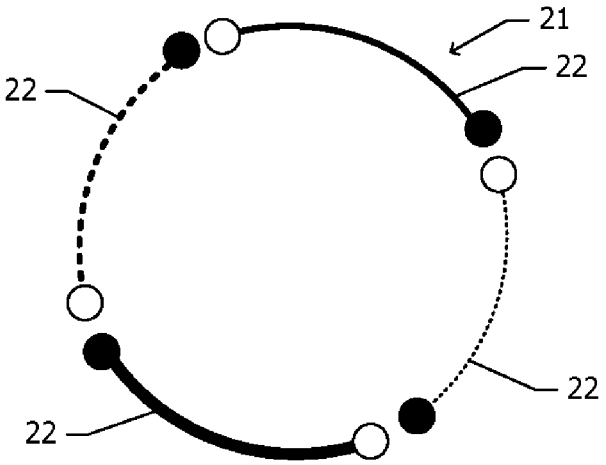
FIG. 5C is a plan view of a third coil conductor layer of the common mode choke coil according to the third embodiment.

FIG. 5A is a plan view of the first coil conductor layer 21 of the common mode choke coil according to the third embodiment. FIG. 5B is a plan view of the second coil conductor layer 21 of the common mode choke coil according to the third embodiment. FIG. 5C is a plan view of the third coil conductor layer 21 of the common mode choke coil according to the third embodiment. Each coil conductor layer 21 contains four coil conductors 22. The coil conductors 22 of the first inductor 20 are denoted by a thick solid line. The coil conductors 22 of the second inductor 20 are denoted by a thick dashed line. The coil conductors 22 of the third inductor 20 are denoted by a thin solid line. The coil conductors 22 of the fourth inductor 20 are denoted by a thin dashed line.

A pattern formed of the four coil conductors 22 contained in each coil conductor layer 21 has four-fold rotational symmetry. According to the third embodiment, the four coil conductors 22 each have an arc shape having the same center 26 and the same radius r. The central angle θ of the arc pattern formed of each coil conductor 22 is slightly less than 90 degrees.

According to the third embodiment, for example, in each coil conductor layer 21, the positional relationship between the coil conductors 22 adjoining in the circumferential direction is not the same as the positional relationship between the coil conductors 22 that face each other across the center. However, a variation in the degree of coupling of any two inductors 20 selected from the four inductors 20 is less than that in the case of a common mode choke coil including four inductors obtained by winding four wires in a regular manner. Accordingly, when the common mode choke coil according to the third embodiment is inserted into a transmission line formed of four lines, a variation in the normal mode impedance between the lines can be decreased.

Fourth Embodiment

A common mode choke coil according to a fourth embodiment will be described with reference to FIG. 6A and FIG. 6B. The following description includes differences from the first embodiment, but a common structure is omitted. According to the first embodiment, the insulating layers 11 are stacked in the vertical direction with respect to the mounting substrate. According to the fourth embodiment, the insulating layers 11 are stacked in the lateral direction with respect to the mounting substrate.

Figure 6A:
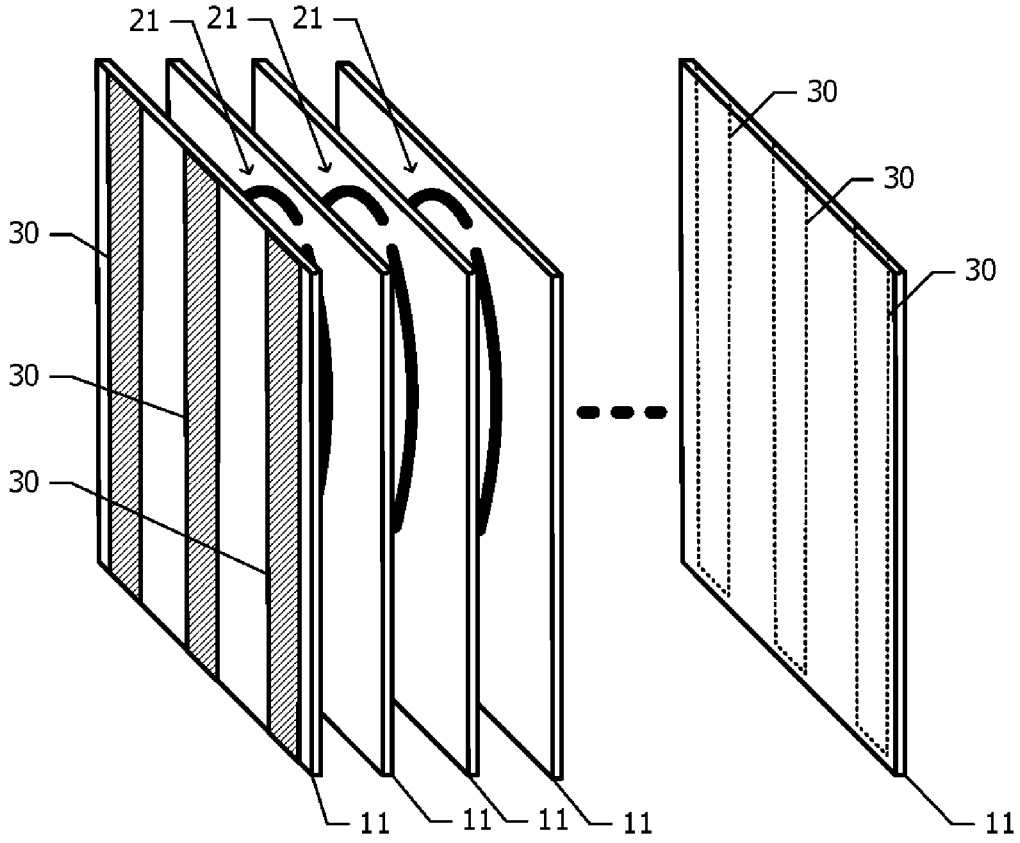
FIG. 6A is a schematic exploded perspective view of a common mode choke coil according to a fourth embodiment.

FIG. 6A is a schematic exploded perspective view of the common mode choke coil according to the fourth embodiment. FIG. 6B is a side view of the common mode choke coil according to the fourth embodiment. FIG. 6B illustrates the coil conductors 22 inside the common mode choke coil that are not actually seen from the outside. The insulating layers 11 are stacked in the lateral direction. Three outer electrodes 30 are formed on the outer surface of each of the outermost insulating layers 11. FIG. 6A and FIG. 6B each illustrate the outer electrodes 30 by hatching. The outer electrodes 30 extend in the direction perpendicular to the stacking direction of the insulating layers 11. The outer electrodes 30 are arranged in a row in the direction parallel to the mounting substrate.

Figure 6B:
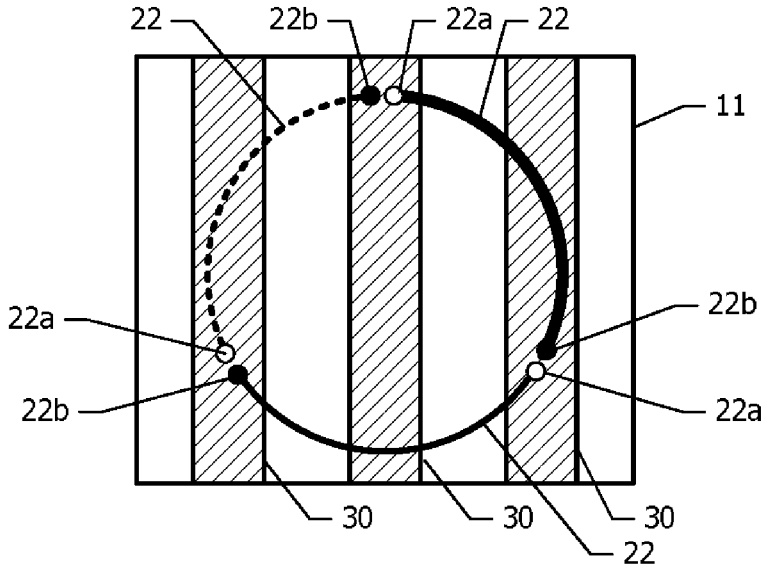
FIG. 6B is a side view of the common mode choke coil according to the fourth embodiment.

As illustrated in FIG. 6B, the start points 22*a* of the three coil conductors 22 contained in one of the outermost coil conductor layers 21 overlap the respective outer electrodes 30. The start points 22*a* and the outer electrodes 30 are connected to each other in a state where the corresponding via conductors (FIG. 1) extending through the insulating layers 11 in the thickness direction are interposed therebetween. The via conductors 23 serve as the lead conductors 25 (FIG. 1) according to the first embodiment.

On the side surface opposite to the side surface illustrated in FIG. 6B, the end points 22*b* of the three coil conductors 22 contained in the other outermost coil conductor layer 21 are connected to the respective outer electrodes 30 with the corresponding via conductors 23 (FIG. 1) interposed therebetween.

The outer electrodes 30 of the common mode choke coil according to the fourth embodiment correspond to the outer electrodes 30 illustrated in FIG. 3A. In FIG. 3A, the stacking direction of the insulating layers 11 corresponds to a left-right direction.

According to the fourth embodiment, the length of each lead conductor 25 (FIG. 1) can be shorter than that in the case of the first embodiment. The length of each lead conductor 25 is equal between the three inductors 20. Accordingly, a variation in the normal mode impedance due to a variation in the self-inductance of each lead conductor 25 can be decreased.

Fifth Embodiment

A common mode choke coil according to a fifth embodiment will be described with reference to FIG. 7A and FIG. 7B. The following description includes differences from the first embodiment, but a common structure is omitted. According to the first embodiment, an angle formed between a radial line passing through each of the start points 22*a* of the coil conductors 22 contained in each coil conductor layer 21 and a radial line passing through each of the end points 22*b* is less than 120 degrees. According to the fifth embodiment, the angle formed between a radial line passing through each of the start points 22*a* of the coil conductors 22 contained in each coil conductor layer 21 and a radial line passing through each of the end points 22*b* is larger than 120 degrees.

Figure 7A:
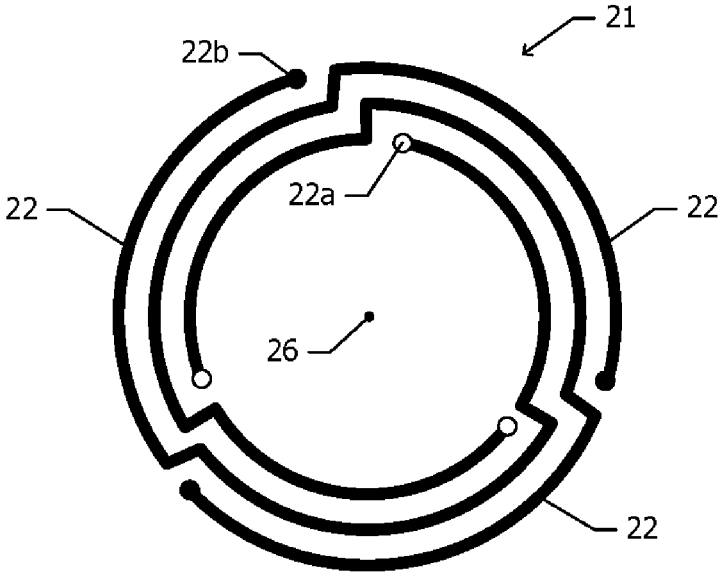
FIG. 7A is a plan view of a first coil conductor layer of a common mode choke coil according to a fifth embodiment.
Figure 7B:
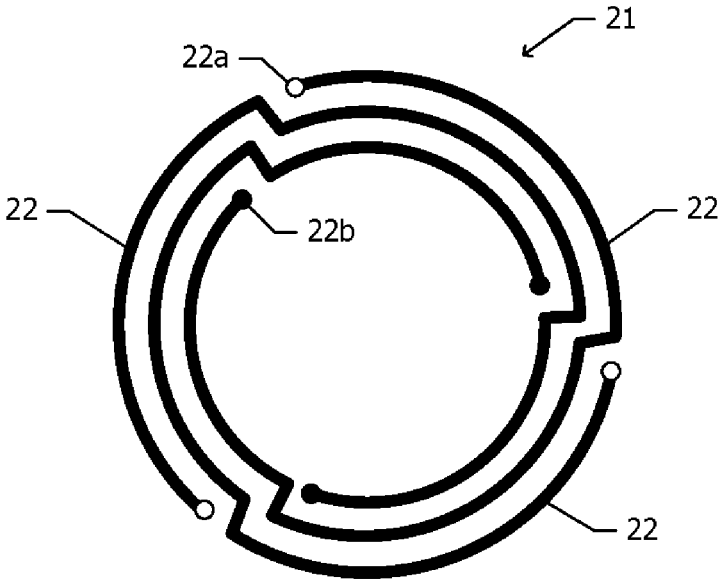
FIG. 7B is a plan view of a second coil conductor layer of the common mode choke coil according to the fifth embodiment.

FIG. 7A is a plan view of the first coil conductor layer 21 of the common mode choke coil according to the fifth embodiment. FIG. 7B is a plan view of the second coil conductor layer 21 of the common mode choke coil according to the fifth embodiment. Each coil conductor layer 21 contains three coil conductors 22. The angle formed between a radial line passing through each of the start points 22*a* of the coil conductors 22 and a radial line passing through each of the end points 22*b* is larger than 120 degrees, and accordingly, the three coil conductors 22 cannot be arranged on a circle without mutual contact.

Each coil conductor 22 has a shape combining arc patterns having the same center 26 and different radiuses. Also, according to the fifth embodiment, a pattern formed of the three coil conductors 22 contained in each coil conductor layer 21 has three-fold rotational symmetry. When an imaginary point on one of the coil conductors 22 in the first coil conductor layer 21 illustrated in FIG. 7A is moved clockwise from the start point 22*a* to the end point 22*b*, the radius of each arc pattern increases stepwise. In contrast, when an imaginary point on one of the coil conductors 22 in the second coil conductor layer 21 illustrated in FIG. 7B is moved clockwise from the start point 22*a* to the end point 22*b*, the radius of each arc pattern decreases stepwise. In the case where the radius of each arc pattern increases or decreases stepwise, the coil conductors 22 can be prevented from coming into contact with each other. The coil conductor layers 21 having the same pattern as the first coil conductor layer 21 and the coil conductor layers 21 having the same pattern as the second coil conductor layer 21 are alternately stacked.

Also, according to the fifth embodiment, the degree of coupling of any two inductors 20 selected from the three inductors 20 is substantially equal. Accordingly, the same effects as in the first embodiment can be achieved. Furthermore, according to the fifth embodiment, the number of turns of each inductor 20 can be increased with a smaller number of layers.

Sixth Embodiment

A common mode choke coil according to a sixth embodiment will be described with reference to FIG. 8A and FIG. 8B. The following description includes differences from the fifth embodiment, but a common structure is omitted.

Figure 8A:
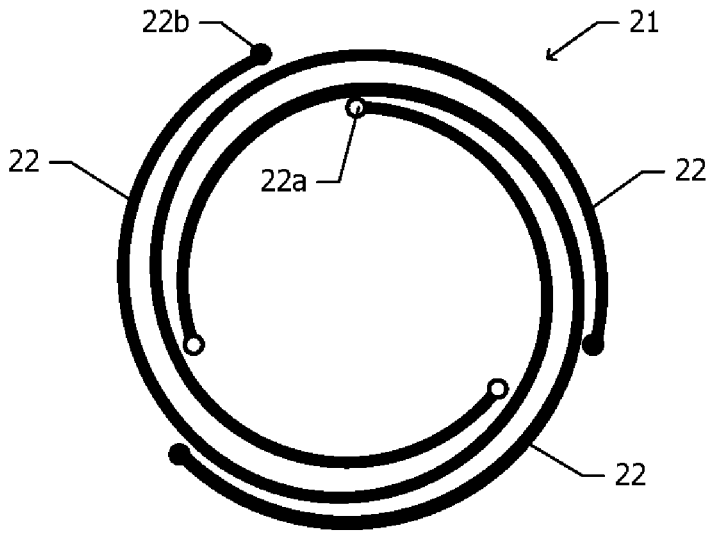
FIG. 8A is a plan view of a first coil conductor layer of a common mode choke coil according to a sixth embodiment.
Figure 8B:
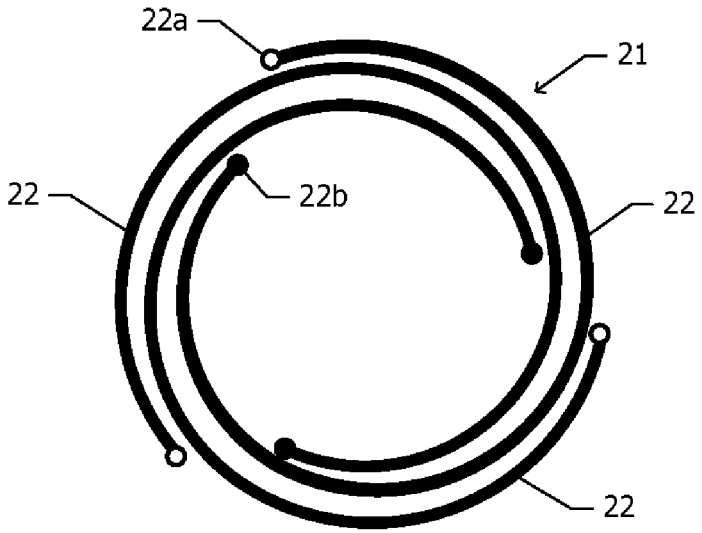
FIG. 8B is a plan view of a second coil conductor layer of the common mode choke coil according to the sixth embodiment.

FIG. 8A is a plan view of the first coil conductor layer of the common mode choke coil according to the sixth embodiment. FIG. 8B is a plan view of the second coil conductor layer of the common mode choke coil according to the sixth embodiment. According to the fifth embodiment, when an imaginary point on each coil conductor 22 is moved clockwise from the start point 22*a* to the end point 22*b*, the radius of each arc pattern increases or decreases stepwise. According to the sixth embodiment, the radius gradually increases or decreases. That is, three coil conductors 22 contained in each coil conductor layer 21 each have a multi-start spiral shape.

Also, according to the sixth embodiment, the degree of coupling of any two inductors 20 selected from the three inductors 20 is substantially equal. Accordingly, the same effects as in the fifth embodiment can be achieved.

It goes without saying that the embodiments are described by way of example, and the structures described in the embodiments can be partially replaced or combined. Description of the same effects achieved by the common structures in the embodiments is omitted in some embodiments. The present disclosure is not limited to the embodiments. For example, it is obvious for a person skilled in the art to enable various modifications, improvements, combinations, and others.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A common mode choke coil, comprising:

an insulating member; and three or more of n inductors arranged inside the insulating member, wherein inside the insulating member, each of the inductors includes coil conductors that are contained in respective coil conductor layers that are stacked in a first direction and via conductors, each of which connects the coil conductors that are contained in the coil conductor layers adjoining in the first direction, wherein each of the coil conductor layers contains the n coil conductors of the inductors, and a pattern formed of the coil conductors contained in each of the coil conductor layers has n-fold rotational symmetry, and wherein the n coil conductors contained in each of the coil conductor layers form respective arc patterns having a same center and a same radius.

2. The common mode choke coil according to claim 1, wherein the number of the inductors arranged inside the insulating member is three.

3. The common mode choke coil according to claim 1, further comprising:

outer electrodes arranged on a surface of the insulating member; and lead conductors, each of which connects each of the outer electrodes to the corresponding one of the n inductors.

4. The common mode choke coil according to claim 1, wherein the coil conductors on each coil conductor layer extend along a circumference of a circle having its origin at the same center of the coil conductors and the same radius of the coil conductors.

* * * * *